US007127345B2

(12) United States Patent
Chen et al.

(10) Patent No.: US 7,127,345 B2
(45) Date of Patent: Oct. 24, 2006

(54) DIESEL ENGINE CONTROL

(75) Inventors: Gong Chen, Erie, PA (US); Richard J. McGowan, Slippery Rock, PA (US); Donald J. Melpolder, Erie, PA (US); Shawn Michael Gallagher, Erie, PA (US); John Patrick Dowell, Niskayuna, NY (US); Kyle Craig Stott, Erie, PA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/343,401

(22) Filed: Jan. 31, 2006

(65) Prior Publication Data

US 2006/0178800 A1 Aug. 10, 2006

Related U.S. Application Data

(60) Provisional application No. 60/651,592, filed on Feb. 10, 2005.

(51) Int. Cl.
*F02D 41/40* (2006.01)

(52) U.S. Cl. ..... 701/105

(58) Field of Classification Search ..... 701/105, 701/103, 104; 123/478, 480
See application file for complete search history.

(56) References Cited

U.S. PATENT DOCUMENTS 4,763,629 A * 8/1988 Okazaki et al. ..... 123/683
6,158,416 A 12/2000 Chen et al.
6,283,100 B1 9/2001 Chen et al.
6,286,311 B1 9/2001 Chen
6,286,480 B1 9/2001 Chen et al.
6,295,816 B1 10/2001 Gallagher et al.
6,318,308 B1 11/2001 Hsu et al.
6,325,044 B1 12/2001 Chen et al.
6,325,050 B1 12/2001 Gallagher et al.
6,327,980 B1 12/2001 Chen et al.
6,341,596 B1 1/2002 Dillen et al.
6,349,706 B1 2/2002 Hsu et al.
6,405,705 B1 6/2002 Dunsworth et al.
6,493,627 B1 12/2002 Gallagher et al.
6,725,134 B1 4/2004 Dillen et al.
6,814,060 B1 11/2004 Solomons et al.
6,823,835 B1 11/2004 Dunsworth et al.
7,000,586 B1 * 2/2006 Kato et al. ..... 123/305

FOREIGN PATENT DOCUMENTS

JP 4-136451 A * 5/1992

* cited by examiner

*Primary Examiner*—Hieu T. Vo
(74) *Attorney, Agent, or Firm*—Carlos Luis Hanze; David G. Maire; Beusse Wolter Sanks Mora & Maire, P.A.

(57) ABSTRACT

A diesel engine (10) wherein both the operating speed of the engine (RPM) and the timing of the fuel injection into the engine (AA) are cooperatively controlled to be responsive to both the temperature and the pressure of the air (30) used for combustion. A controller (44) receives a temperature signal (28), an air pressure signal (36), and a power demand signal (24) and executes control logic to produce a fuel injection control signal (46) and an engine speed control signal (48) for controlling a fuel injection system (16). A control strategy based on engine inlet air temperature and pressure or manifold air density may be useful for variable speed and power applications. For applications with discreet speed and power points, such as a locomotive, a speed and timing control strategy based on ambient temperature and pressure is useful for maximizing power during high altitude and/or high ambient/inlet air temperature operation.

19 Claims, 2 Drawing Sheets

DIESEL ENGINE CONTROL

RELATED APPLICATIONS

This application claims benefit of the Feb. 10, 2005, filing date of U.S. Provisional Patent Application No. 60/651,592.

FIELD OF THE INVENTION

This invention relates generally to the control of compression-ignition diesel engines.

BACKGROUND OF THE INVENTION

Power is generated in a compression-ignition diesel engine such as a diesel engine by diffusing and combusting diesel fuel or alternate liquid fuels in a plurality of engine cylinders. Liquid fuel is injected into the engine cylinders that are full of compressed air at high temperature. The fuel is broken up into droplets that evaporate and mix with the air in the cylinders to form a flammable mixture. Complete and efficient combustion in the cylinders requires full oxidation of the fuel though evaporation, species diffusion, and mixing with air, and timely heat release during the combustion process. Thus, the amount of cylinder-charged air, or air to fuel ratio of the mixture, plays an important role in diesel engine fuel-air mixing and combustion, which, in turn affects fuel efficiency, exhaust emissions and engine thermal and mechanical loadings. This is particularly true for quiescent chamber type medium speed heavy-duty diesel engines where the cylinder air intake swirling is slight, such as locomotive, marine or stationary power engines having cylinders with relatively large displacement volumes. The fuel injection timing of medium speed diesel engines burning diesel or alternative fuels and operating at full load is typically set so that the actual peak firing pressure in the cylinders is at or below a maximum allowable cylinder firing pressure for a given intake air temperature and pressure as determined by ambient conditions.

Engine exhaust emissions, including carbon monoxide (CO), particulate matters (PM) and smoke are generated when the air-fuel mixture is incompletely combusted. When engines are operated at higher ambient temperatures and higher altitudes, i.e., at a low barometric pressure, or at a higher ambient/engine inlet air temperature, or both, lesser amounts of air are introduced into the cylinders, causing the air-fuel mixing process to be deteriorated relative to lower intake air temperatures and lower altitude, higher ambient pressure and normal ambient/inlet air temperature environments. This combination of factors increases late and incomplete combustion in the engine cylinders which lowers fuel efficiency and increases exhaust emissions of CO, PM, and smoke. The reduced amount of air for the fuel-air mixture combustion, together with the increased late and incomplete combustion, typically leads to reduced peak cylinder firing pressure and increased cylinder exhaust gas temperatures. For engines including a turbocharger, the decreased barometric pressure or increased ambient/inlet air temperature or both resulting in the increased exhaust temperature causes an increase in turbocharger speed and thermal loads on cylinder exhaust and turbocharger components. This may require a reduction of power output to prevent turbocharger damage from overheating and excessive speed. Also as ambient/inlet air temperature becomes lower than normal, peak cylinder firing pressure increases thus increasing mechanical loading on engine cylinder assembly components and affecting the engine reliability and durability.

U.S. Pat. No. 6,158,416 describes a diesel engine control scheme for high altitudes wherein engine speed and fuel injection timing are adjusted in response to a sensed barometric pressure and engine throttle position. U.S. Pat No. 6,286,480 describes a diesel engine control scheme for high altitudes wherein fuel injection timing is adjusted in response to a sensed barometric pressure and engine throttle position. U.S. Pat. No. 6,325,050 describes a diesel engine control scheme wherein fuel injection timing is controlled in response to measured values of barometric pressure and manifold air temperature. Each of these three patents is incorporated by reference herein.

DETAILED DESCRIPTION OF THE INVENTION

Figure 1:
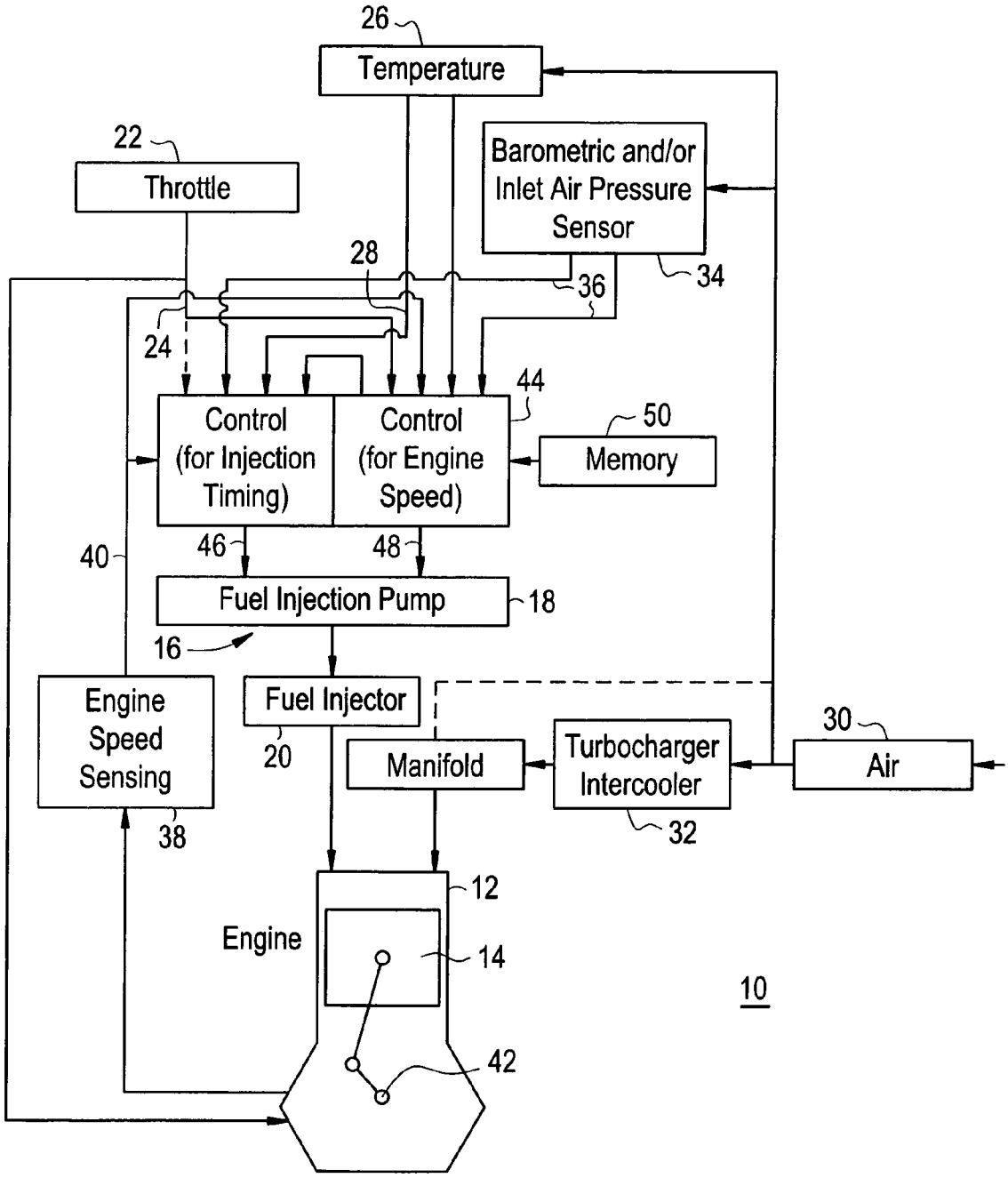
FIG. 1 is a schematic illustration of a diesel engine control system.

FIG. 1 is a schematic illustration of a diesel engine 10 using diesel or alternate liquid fuels and incorporating an improved combustion control scheme providing enhanced engine performance in extreme environmental conditions such as high altitude or high ambient temperature operation. Engine 10 is representative of any large, medium-speed, multi-cylinder diesel engine such as may be used in locomotive, marine or power generation applications. Engine 10 includes a plurality of power cylinders 12 (one illustrated) each having a piston 14 reciprocating therein. A fuel injection apparatus 16 injects fuel into the respective cylinders 12 in timed sequence with the reciprocation of the pistons 14. The fuel injection apparatus 16 may include a fuel pump 18, a fuel injector 20 and/or optionally other devices such as a valve associated with each cylinder 12. The engine also includes an engine power and/or throttle position selection and sensing apparatus, collectively referred to herein as throttle 22. The throttle 22 provides a power demand signal 24 that is responsive to an operator throttle input. For locomotive engines, the throttle input will typically include a plurality of discrete throttle settings that are commonly referred to as notches, such as N1 thru N8, plus an idle setting. A temperature sensor 26 provides a temperature signal 28 responsive to a temperature of the air 30 being delivered to the engine 10 to support combustion. The temperature sensor 26 may be configured to measure the temperature of ambient air or inlet air entering the turbocompressor, or alternatively as indicated by the dashed line in FIG. 1, it may measure manifold air temperature downstream of a turbocharger/intercooler system 32. Alternatively, the temperature sensor may be configured to measure both ambient/inlet air temperature and manifold air temperature. A pressure sensor 34 provides a pressure signal 36 responsive to a pressure of the air 30. The pressure sensor 34 may also be configured to measure the ambient atmospheric pressure or it may measure a manifold air pressure, or both. An engine speed sensor 38 provides an engine speed signal 40 responsive to the engine operating speed as indicated by the rotating speed of the engine crankshaft 42, for example.

A controller 44, such as any microprocessor known in the art, is provided for controlling the fuel injection system 16 and engine speed using an imbedded software program to maintain the power demand requested by the throttle position 22 and to achieve a desired output performance. Controller 44 may be any style of controller known in the art, and is typically a computer or microprocessor configured to execute programmed instructions stored on a computer readable medium, for example memory 50 which may be a hard or floppy magnetic disk, a laser readable disk, a memory stick, etc. The controller 44 receives the power demand signal 24, the temperature signal or signals 28, the pressure signal or signals 36 and the engine speed signal 40 as inputs, among other signals. Upon executing programmed logic, the controller 44 provides a fuel injection control signal 46 to fuel injection system 16 to control the quantity (fuel value FV) and timing (advance angle AA) of the injection of fuel into the respective cylinders 12. The advance angle is the position of the crankshaft 42 at which the fuel injection is initiated for a given cylinder 12 expressed in degrees of rotation before a top-dead-center position of the respective piston 14.

The present inventors have observed that prior art combustion control systems are sometimes unable to accommodate extreme environmental conditions without a reduction in the power output of the engine. In particular, the present inventors have observed that the operation of a typical large (3,000–6,000 horsepower), medium speed (approximately 1050 rpm), 12–16 cylinder diesel engine for locomotive or stationary power generation applications at altitudes of over 8,000 feet above sea level or very high ambient temperature conditions can sometimes require a de-rating of the peak engine power output level in order to satisfy various engine operating criteria, such as peak combustion chamber pressure, cylinder exhaust temperature, turbocharger speed, emissions limits, etc. For example, prior art engines may require significant redesign to operate within modern NOx emission limits at high altitudes. This is because it is necessary to retard fuel injection timing (i.e. 0–5 degrees BTDC) in order to achieve low NOx operation. To maintain the NOx level and run with the retarded timing, the turbocharger and engine breathing would have to be reconfigured to the high altitude or high ambient/inlet air temperature conditions in order to avoid excessive turbo speed and temperatures resulting from late combustion and excessive energy in the exhaust. Also, prior art engines may require a de-rating of engine power to maintain peak cylinder firing pressure within its operating limit when ambient/inlet air temperature is much lower than normal while barometric pressure remains normal. Engine 10 of FIG. 1 incorporates programmed logic executable by the controller 44 that provides improved performance in such conditions without the need for mechanical changes to the turbocharger, power assembly or engine breathing equipment and with reduced or no de-rating of engine power effort for a compression-ignition diesel engine using diesel or alternate liquid fuels. The programmed logic allows controller 44 to control concurrently both the speed of operation of the engine 10 within any predetermined throttle setting and the timing of the fuel injection into the cylinders 12 of the engine 10 in response to both the temperature signal 28 and the pressure signal 36. Prior art systems that have controlled both engine speed and fuel injection timing, such as those described by U.S. Pat. Nos. 6,158,416 and 6,286,480, have based such control on a measured ambient air pressure value, but have not provided a control responsive to ambient or combustion air temperature. Accordingly, such systems have incorporated a conservatively assumed value for air temperature that is most often a higher temperature that that actually experienced by the locomotive. Prior art systems that have controlled fuel injection timing based upon barometric pressure, such as U.S. Pat. No. 6,325,050, have constrained engine operation to predetermined engine speed values corresponding to the selected throttle notch setting. The present inventors have innovatively developed a control strategy implemented in programmed logic that is capable of responding to and of exploiting the synergistic effects of air pressure, air temperature, fuel injection timing and engine speed to more robustly react to very high altitude operation and other extreme operating conditions including high or low ambient/inlet air temperatures in a manner that effectively eliminates the need for engine power de-ratings in locomotive, marine and power generation applications.

In one embodiment, such as an application with discrete speed/power settings such as a locomotive, the present invention includes programmed logic implementing a method of controlling engine 10 that includes monitoring the temperature and pressure of the ambient air 30 and transmitting a temperature signal 28 and a pressure signal 36 to controller 44. For a predetermined throttle setting, as indicated by power demand signal 24, the controller 44 produces both a fuel injection control signal 46 for controlling the fuel injection timing and an engine speed control signal 48 for concurrently controlling the engine speed in response to the measured air temperature and pressure. Programmed logic for accomplishing such a control scheme may be implemented with an imbedded software program by storing a series of look-up tables in memory 50 accessible by the controller 44. Control values for fuel injection timing advance angle and engine speed are stored in respective look-up tables for a plurality of air temperature/pressure combinations. Distinct control values may be provided for distinct engine power/throttle levels. These control values may be calculated to produce optimal engine performance using known numeric models of the combustion process and/or developed algorithms for the outputs as functions of those input variables, or they may be derived from empirical data.

In one embodiment, the engine speed and fuel injection timing may be controlled to predetermined fixed values for a first throttle setting, and the engine speed and fuel injection timing may be controlled to be responsive to combustion air temperature and pressure for a second throttle setting. For example, for notch settings N1–N6 of a locomotive engine, the engine speed and fuel injection timing may be controlled to respective predetermined fixed values defined in a first set of look-up tables. For notch setting N7 of the engine, the engine speed and fuel injection timing may be controlled to values that are adjusted to account for variations in measured air temperature and pressure, such as may be defined in a second set of look-up tables. Further, for notch setting N8, a third and different set of look-up tables may be used to control engine speed and fuel injection timing in response to measured air temperature and pressure.

In another embodiment, the engine control strategy may be varied for altitudes above a predetermined height, such as above 8,000 feet above sea level, for example. One or more restrictive operational limitations, such as an exhaust emission limit or a mechanical or thermal loading limit, may be relaxed above a predetermined altitude. By relaxing a limiting design restriction in only such extreme environmental conditions, the benefit of increased engine efficiency and power output may be found to exceed the cost of a related adverse consequence resulting from the relaxation of the design limit. In the example of a relaxed exhaust emission for locomotives operating, the locomotive operator or regulatory body may find that a slightly increased level of emissions at very high altitudes is tolerable because of the relatively remote nature of most high altitude railroad tracks;

or conversely, that the higher speed achievable by avoiding an engine power reduction may actually tend to disperse emissions more effectively and thus counterbalance the slightly higher emissions level.

Figure 2:
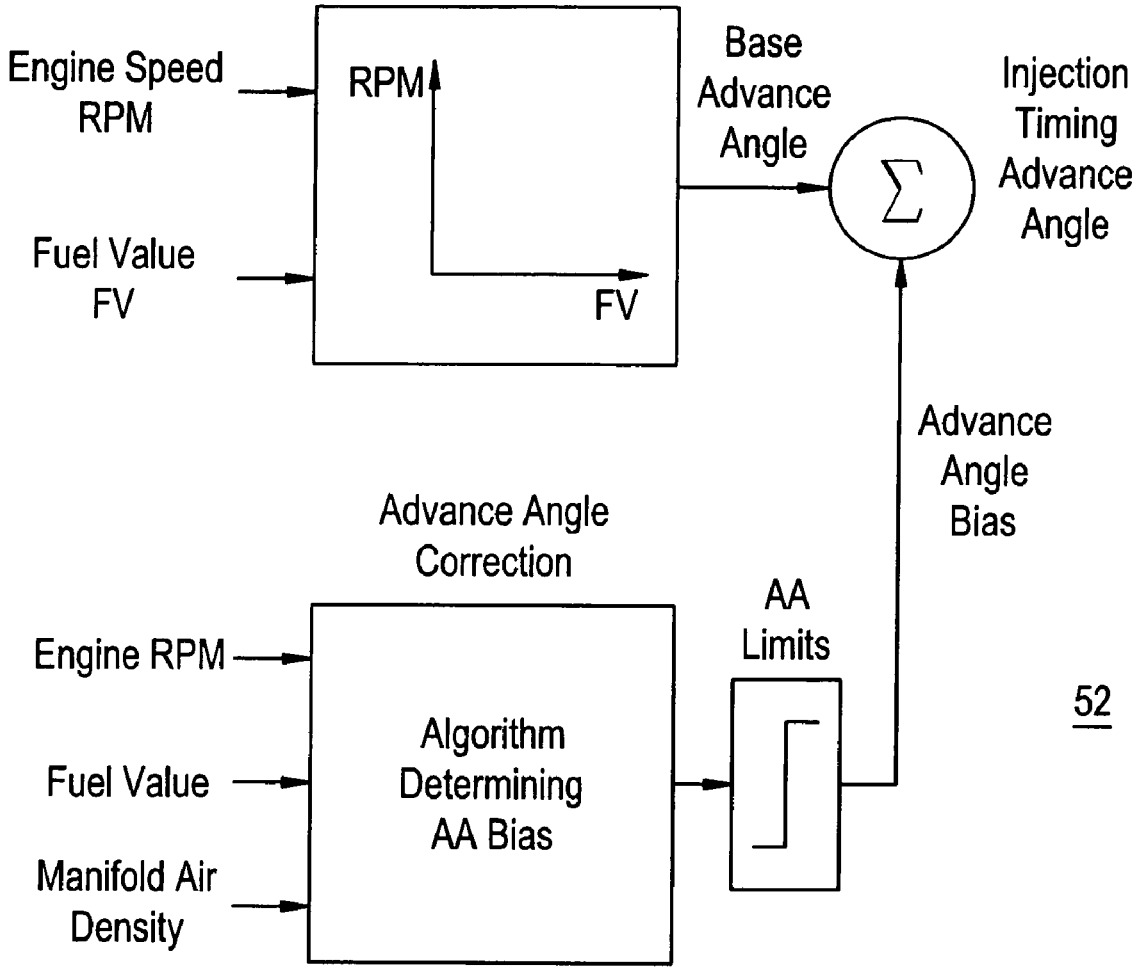
FIG. 2 is a schematic illustration of a fuel injection timing control loop.

In another embodiment, such as applications with variable speed/power schedules such as marine engines, the measured combustion air temperature and pressure values are used to calculate an air density value. Such calculation may be done in controller 44 or elsewhere. A signal responsive to the calculated air density may be used in controller 44 for determining concurrent values for fuel injection control signal 46 and engine speed control signal 48. FIG. 2 is a schematic illustration of a fuel injection timing control loop 52 used in such an embodiment. For a given engine power demand/throttle setting, a base timing is predetermined and stored in memory 50 from an engine speed and power look-up table. A base timing may alternatively be determined from programmed algorithms that relate the inputs such as engine speed and power and/or fuel value to base injection timing as an output. The fuel value (FV) corresponding to the volume of fuel delivered to each cylinder 12 on each power process of piston 14 can be used in place of power in applications where the controller does not know power directly to maintain the desired engine speed. A base advance angle is determined and is provided to a summing device. In parallel, an algorithm is executed with the measured engine speed, power (and/or optionally fuel value) and measured manifold air density (calculated from manifold air temperature and pressure) as inputs in order to obtain an advance angle bias that is also provided to the summing device. The summing device thus provides an output for control of the fuel injection timing that is responsive to both inlet air temperature and pressure, or both intake manifold air temperature and pressure. An alternative approach may be to determine timing directly from a multiple dimensional table that includes injection timing and/or timing bias, speed, power, or fuel value per injection and manifold air density. The multiple dimensions tables could appear in software as a series of timing tables based on speed, fuel value or power and manifold air density. Each table in the series corresponds to a different power and/or fuel value level. At intermediate speed or power levels, the timing may be determined by interpolation.

While the preferred embodiments of the present invention have been shown and described herein, it will be obvious that such embodiments are provided by way of example only. Numerous variations, changes and substitutions will occur to those of skill in the art without departing from the invention herein.

The invention claimed is:

1. A multi-cylinder diesel engine providing enhanced performance in high ambient temperature and high altitude conditions comprising:

a plurality of power cylinders;

a piston reciprocating within each respective power cylinder;

a fuel injection system injecting fuel into the cylinders in timed sequence with reciprocation of the respective piston;

a throttle providing a power demand signal responsive to a plurality of discrete operator throttle input selections;

a temperature sensor providing a temperature signal responsive to a temperature of air used for combustion of the fuel in the cylinders;

a pressure sensor providing a pressure signal responsive to a pressure of the air;

an engine speed sensor providing an engine speed signal responsive to an operating speed of the engine;

a controller receiving the power demand signal, the temperature signal, the pressure signal and the engine speed signal; and programmed logic executable by the controller for generating an engine speed signal and a fuel injection control signal for cooperatively controlling both engine speed and timing of the injection of fuel into the respective cylinders in response to both the temperature and the pressure of the air.

2. The engine of claim 1, further comprising a memory accessible by the processor and storing respective control values for both fuel injection timing and for engine speed for a plurality of air temperature/pressure combinations.

3. The engine of claim 2, further comprising the memory containing respective control values for both fuel injection timing and for engine speed for a plurality of air temperature/pressure combinations for a plurality of respective power demand signal values.

4. The engine of claim 1, further comprising programmed logic executable by the controller for controlling engine speed and fuel injection timing to respective first predetermined values for a power demand signal corresponding to a first throttle input selection and for cooperatively controlling both engine speed and timing of the injection of fuel into the respective cylinders to respective second predetermined values in response to both combustion air temperature and pressure for a second power demand signal corresponding to a second throttle input selection.

5. The engine of claim 1, wherein the programmed logic comprises a control loop comprising:

a base injection timing advance angle element responsive to engine speed and an engine power variable to determine a base advance angle;

an advance angle correction element responsive to engine speed, an engine power variable, air temperature and air pressure to determine an advance angle correction value; and a summing device receiving the base advance angle and the advance angle correction value and determining an injection timing advance angle.

6. A microprocessor product comprising a computer-accessible imbedded software program for controlling a large, medium-speed, multi-cylinder diesel engine in extreme environmental conditions, the processor program regulating a fuel injection system of the engine to cooperatively control both an engine speed and a timing of fuel injection into cylinders of the diesel engine to be responsive to measurements of both a temperature and a pressure of air used for combustion in the engine.

7. The microprocessor program product of claim 6, further comprising a plurality of data tables stored in the storage medium containing control values for engine speed and fuel injection timing corresponding to respective values of air temperature and air pressure.

8. The microprocessor program product of claim 7, wherein the data tables further comprise control values for engine speed and fuel injection timing corresponding to respective values of air temperature and air pressure for each of at least two predetermined power levels of the engine.

9. The microprocessor program product of claim 6, further comprising the imbedded program performing a step of calculating a density value responsive to the temperature and the pressure of the air and further regulating the fuel injection system of the engine to cooperatively control both engine speed and timing of fuel injection to be responsive to the calculated density value.

10. The microprocessor program product of claim 6, further comprising a plurality of programmed algorithms stored in the storage medium for determining control values for engine speed and fuel injection timing corresponding to respective values of air temperature and air pressure.

11. The microprocessor product of claim 6, further comprising:

a base injection timing advance angle element responsive to engine speed and an engine power variable to determine a base advance angle;

an advance angle correction element responsive to engine speed, an engine power variable, air temperature and air pressure to determine an advance angle correction value; and a summing device receiving the base advance angle and the advance angle correction value and determining an injection timing advance angle.

12. A method of controlling combustion in a large, medium-speed, multi-cylinder diesel engine having discrete throttle settings for enhanced engine performance, including in extreme environmental conditions, the method comprising:

monitoring a temperature of air delivered to the diesel engine for combustion and transmitting a temperature signal indicative of the air temperature to a controller;

monitoring a pressure of the air delivered to the diesel engine for combustion and transmitting a pressure signal indicative of the air pressure to the controller; and concurrently controlling at the controller both a speed of operation of the engine within a predetermined throttle setting and a timing of fuel injection into the cylinders of the engine in response to both the temperature and pressure signals for the air delivered to the engine.

13. The method of claim 12, further comprising:

defining a plurality of predetermined throttle settings;

controlling engine speed and fuel injection timing to respective first predetermined values when operating the engine at a first of the throttle settings; and controlling engine speed and fuel injection timing to be responsive to both the temperature and pressure signals when operating the engine at a second of the throttle settings.

14. The method of claim 13, further comprising:

controlling engine speed and fuel injection timing to a first set of predetermined values responsive to both the temperature and pressure signals when operating the engine at the second of the throttle settings; and controlling engine speed and fuel injection timing to a second set of predetermined values responsive to both the temperature and pressure signals and different than the first set of predetermined values when operating the engine at a third of the throttle settings.

15. The method of claim 13, further comprising:

determining respective control values for engine speed and fuel injection timing for operating the engine at the second of the throttle settings over a range of combustion air temperature and pressure values;

storing the control values in a memory;

providing an engine controller having access to the memory and having the temperature and pressure signals as inputs; and executing logic with the engine controlled to control the engine speed and fuel injection timing to be responsive to the temperature and pressure signals in accordance with the stored control values when operating the engine at the second of the throttle settings.

16. The method of claim 12, further comprising:

controlling both the speed of the engine and the timing of fuel injection concurrently to achieve a desired power output and to satisfy a predetermined operational limit at elevations below a predetermined altitude; and controlling both the speed of the engine and the timing of fuel injection concurrently to achieve the desired power output without considering the predetermined operational limit at elevations above the predetermined altitude.

17. The method of claim 16, further comprising controlling both the speed of the engine and the timing of fuel injection concurrently to achieve the desired power output without considering a predetermined exhaust emission limit at elevations above a predetermined altitude.

18. The method of claim 12, further comprising controlling both the speed of the engine and the timing of fuel injection in response to a calculated value of intake manifold air density.

19. The method of claim 13, further comprising:

determining a base injection timing advance angle;

determining an advance angle correction value responsive to the temperature and pressure signals; and summing the base injection timing advance angle and the advance angle correction value to determine an injection timing advance angle.

* * * * *